US006793090B2

(12) United States Patent
Ackerman et al.

(10) Patent No.: US 6,793,090 B2
(45) Date of Patent: Sep. 21, 2004

(54) ELASTIC CONTAINER COVER AND METHOD FOR MANUFACTURING

(75) Inventors: Bryan L. Ackerman, Midland, MI (US); Leland J. Smith, Midland, MI (US)

(73) Assignee: S.C. Johnson Home Storage, Inc., Racine, WI (US)

( * ) Notice: Subject to any disclaimer, the term of this patent is extended or adjusted under 35 U.S.C. 154(b) by 4 days.

(21) Appl. No.: 10/306,191

(22) Filed: Nov. 27, 2002

(65) Prior Publication Data

US 2004/0099667 A1 May 27, 2004

(51) Int. Cl.[7] ..... B65D 51/00

(52) U.S. Cl. ..... 220/287; 215/319; 150/154; 15/322

(58) Field of Search ..... 220/287, 796; 215/319; 150/154; 156/322, 197, 176; 493/341, 379, 380

(56) References Cited

U.S. PATENT DOCUMENTS

| | | | | |
|---|---|---|---|---|
| 2,080,108 A | | 5/1937 | Brandstein | |
| 2,490,451 A | | 12/1949 | Magid | |
| 2,730,720 A | | 1/1956 | Saunders | |
| 2,821,230 A | | 1/1958 | May | |
| 3,133,656 A | | 5/1964 | Foster | |
| 3,587,113 A | | 6/1971 | Harriague | |
| 3,793,110 A | | 2/1974 | Saunders | |
| 3,852,823 A | | 12/1974 | Jones | |
| 3,862,614 A | | 1/1975 | Kovac | |
| 4,542,833 A | * | 9/1985 | DeVaughn | 215/319 |
| 4,560,434 A | | 12/1985 | Sato | |
| 4,765,854 A | | 8/1988 | McKeown | |
| 4,844,248 A | | 7/1989 | Forberg et al. | |
| 4,901,881 A | | 2/1990 | McElroy | |
| 5,339,981 A | * | 8/1994 | Kral | 220/580 |
| 5,709,312 A | | 1/1998 | Lake | |
| 6,052,825 A | | 4/2000 | Dodd | |
| 6,260,729 B1 | | 7/2001 | Mitchell et al. | |
| 6,276,551 B1 | | 8/2001 | Miller, II | |
| 6,405,890 B1 | | 6/2002 | Ashley | |
| 2003/0082320 A1 | | 5/2003 | Toussant et al. | |

OTHER PUBLICATIONS

S. C. Johnson & Son, Inc., Spran™ QuickCovers™ Lids, ©2002 web page at (http://www.saranbrands.com/saran_fop_qclids.asp); site describes "QuickCovers™" and shows the product in use, Feb. 5, 2003.

* cited by examiner

*Primary Examiner*—Jacob K. Ackun, Jr.

(57) ABSTRACT

An ovate-shaped container cover includes one layer of cover material that substantially covers a container, while a second layer of cover material adapted with an elastic border for gripping the walls of a container is substantially adjacent to the walls of the container. The container cover, when placed atop a container, is capable of forming a dome. Further disclosed is an automated method for manufacturing container covers of the ovate design described above.

26 Claims, 3 Drawing Sheets

ELASTIC CONTAINER COVER AND METHOD FOR MANUFACTURING

FIELD OF THE DISCLOSURE

The present disclosure generally relates to container covers. More particularly, the present disclosure relates to disposable container covers, and automated methods for manufacturing container covers.

BACKGROUND OF THE DISCLOSURE

Disposable container covers capable of covering containers of various sizes and shapes have been in use for many years. Such covers typically include a plastic film, such as polyethylene, provided in sufficient dimension to overly the container opening. The film then employs surface tension or elastic bands to secure the film to the container, such as with Saran® wrap or Quick Covers®, respectively, both being products of the present assignee, with the latter having an elastic band sewn directly to the film around its perimeter. The elastic band bordering the film is attached in such a manner that tension is created on the film, thereby creating a hollow enclosure with an expandable opening for placing atop and around containers of various sizes and shapes.

Use of these container covers is common for both perishable and nonperishable items. While these covers are beneficial in many respects, they are not without room for improvement. A common problem with existing container covers is their shape and the excessive amount of material used in constructing the covers. Specifically, much of the film utilized in the construction of conventional container covers is excessive with regard to the actual surface area needed to cover containers. For instance, typical container covers are constructed using a round piece of film and elastic for attachment at the border of the film. The tension created on the film by the elastic results in numerous pleats at the border of the film, therefore, when the cover is not fully expanded, much of the surface area of the cover is not utilized. This is especially true where the container being covered is much smaller than that for which the cover is, in its fully expanded state, capable of covering. While this manner of construction results in a functional container cover, much of the surface area of the film is not actually in use and is there only by default, as necessitated by the design of the cover. Also problematic of this design is the shapeless, relatively loose-fitting manner of coverage, which conventional covers typically provide. Among other things, this characteristic is directly related to the excessive material used in the construction of conventional container covers.

An additional problem with conventional container covers relates to manufacturing. Specifically, conventional container covers, as described above, require the slow, labor intensive manufacturing step of manually sewing an elastic band to the periphery of the film. These covers do not readily lend themselves to high-speed automated manufacturing, in turn, driving up the cost and time of manufacturing conventional container covers.

SUMMARY OF THE DISCLOSURE

In accordance with one aspect of the disclosure, a container cover is provided which comprises two layers of ovate-shaped film situated planar to one another and heat sealed along their corresponding perimeters. Disposed in the second layer of film is a score line running between first and second points on the perimeter. A scored elastic strip is also attached to the second layer of film, wherein the score line of the elastic strip is aligned with the score line on the second layer of film. This manner of construction requires the user to create the container cover opening by pulling apart the scored layer of film, thereby creating an opening for placing atop a container. In accordance with another aspect of the disclosure, a container cover is provided wherein the first layer of film is perforated, thereby allowing for air and moisture ventilation through the container cover. Also embodied by the present disclosure is a container cover, wherein the first layer of film is rigid in comparison to the second layer. In accordance with yet additional aspects of the disclosure, container covers are provided wherein the elastic strip attached on the second layer of film is sewn directly to the film, heat sealed to the film, glued to the film, or otherwise attached to the film.

In accordance with another aspect of the disclosure, a method is provided for covering a container which comprises the steps of: (1) providing a container cover as described above having two layers of film cut in an ovate shape and attached at their perimeters, wherein one layer has a scored elastic strip aligned with a score line disposed in the film; (2) separating, by pulling apart, the scored layer of film at the score line of the film and the elastic strip, thereby creating an opening in the container cover; and (3) expanding the cover's opening and placing the cover over a container with the separated layer of film adjacent to the walls of the container and the elastic strips gripping the container. Further provided by the disclosure is an additional step of situating the container cover over the container such that the film forms a dome over the container. Alternatively, the container cover of the present disclosure can be situated to fit closely atop a container.

In accordance with yet another aspect of the disclosure, a method of manufacturing a container cover is disclosed which comprises the steps of providing a first web of film; providing a second web of film having a elastic strip secured thereto; perforating both the elastic strip and the second web of film; cutting a shape through the web, second web, and elastic strip; and sealing the first web to the second web around their corresponding perimeters. Further provided by the present disclosure is the method of manufacturing the container cover above, wherein a heated knife is use to cut the first web, second web, and the elastic strip in an ovate shape. Also in accordance with the present disclosure are methods of manufacturing, wherein the elastic strip is provided in a pre-perforated form. Alternatively, in accordance with the present teachings is a method wherein both the elastic strip and the second of film are perforated using a rotating, toothed wheel.

These and other aspects and features of the disclosure will become more apparent from the following detailed description when taken in conjunction with the accompanying drawings.

Figure 1A:
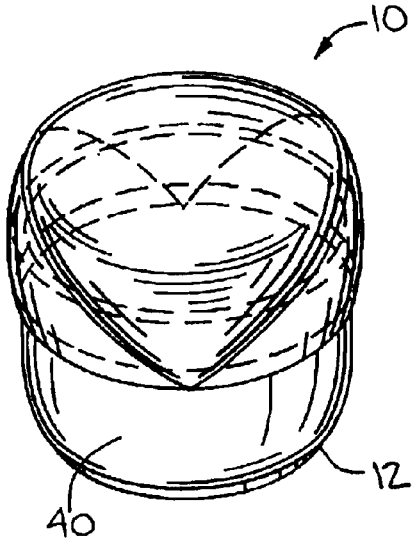
FIGS. 1A and B are perspective views of a typical container utilizing a container cover constructed in accordance with the teachings of the present disclosure.

While the disclosure is susceptible to various modifications and alternative constructions, certain illustrative embodiments thereof have been shown in the drawings and will be described below in detail. It should be understood, however, that there is no intention to limit the disclosure to the specific forms disclosed, but on the contrary, the intention is to cover all modifications, alternative constructions, and equivalents falling within the spirit and scope of the disclosure as defined by the appended claims.

DETAILED DESCRIPTION OF THE DISCLOSURE

Figure 1B:
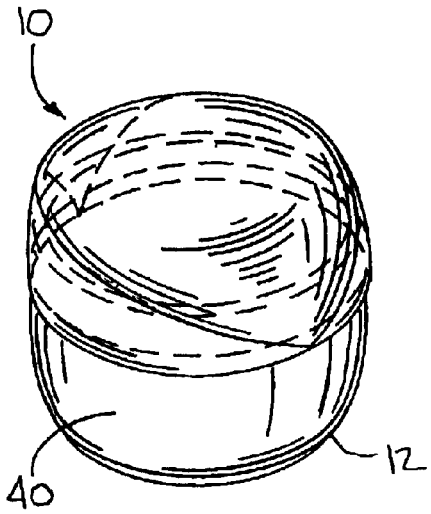

Referring now to the drawings, and with specific reference FIGS. 1 A and B, a container cover constructed in accordance with the present disclosure is generally referred to by reference numeral 10. Container covers 10 of the present disclosure can be used for covering containers 12 such as, but not limited to, bowls, pots, and pans. It is to be understood that the container cover 10 can be used for food storage or perishable goods other than food, as well as, nonperishable goods.

Furthermore, while the container cover 10 depicted is constructed using thermoplastic film, such as polyethylene, also embodied by the present disclosure is the use of any film including, but not limited to, other polymers, waxed paper, metallic foil, parchment paper, and the like. Further embodied by the present disclosure is a container cover 10 having a rigid layer capable of forming a dome when positioned atop a container 12. This rigid layer may be constructed from any semi-flexible material including, but not limited to, Mylar, high density polypropylene, polyethylene, or poly(ethylene) terephthalate. In yet another embodiment of the present disclosure, a top layer of a container cover 10 includes stiffening strips that cause the cover 10 to flex into an arch, thereby forming a dome when positioned atop a container 12. As will also be evident to one with skill in the art, the container covers 10 of the present disclosure may be constructed from perforated film, thereby allowing air and moisture to pass through the container cover 10. This characteristic is oftentimes desired, for example, when storing fruit and/or vegetables.

Figure 2:
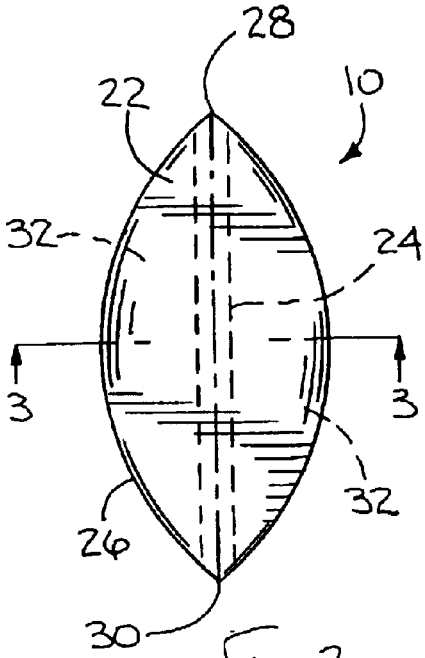
FIG. 2 is a top view of the container cover of FIG. 1 depicted in a partially expanded state.
Figure 3:
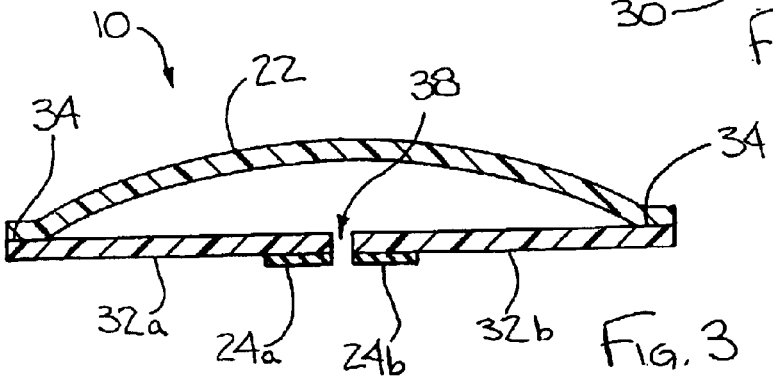
FIG. 3 is a sectional view, taken along line 3—3 of FIG. 2, of the container cover of FIG. 2, wherein the second layer of film is separated at its scored line.

FIGS. 2 and 3 illustrate a container cover 10 from a top view and a sectional view, respectively. As best shown in FIG. 2, the container cover 10 is constructed in an ovate shape. For the purposes of this disclosure, ovate will be defined as oblong or football-like in shape. Specifically, illustrated by FIG. 2 is the ovate-shaped first layer of film 22 defining a perimeter 26 of the container cover 10. The container cover 10 is depicted in a partially expanded state, an elastic strip 24 being illustrated using a dotted or phantom line that extends between two pointed ends 28, 30 of the ovate shape. The elastic strip 24 is attached to the second layer of film, as will be described in further detail herein. It is to be understood by one with skill in the art that embodied by the present disclosure are container covers 10 having the elastic strip 24 sewn, glued, heat sealed, or otherwise directly attached to the second layer of film. In yet additional embodiments, the second layer of film can be folded over and attached to itself, thereby creating a seam for housing the elastic 24. Likewise, an additional piece of film or cover material can be attached at two points to the second layer, thereby creating a compartment for housing the elastic material 24.

Referring to FIG. 3, a sectional view of the container cover 10, taken along line 3—3 of FIG. 2, is illustrated. The container cover 10 is shown to include the first layer of film 22 attached to the second layer of film 32 at their edges 34. The two layers of film 22, 32 can be attached using glue, by heat sealing together, or by any other means of attachment. As shown in FIG. 3, the second layer of film 32 is provided with the aforementioned elastic strip 24. The second layer of film 32 and the elastic strip 24 are scored along the center of the elastic strip 24 running between the two points of the ovate shape, 28, 30 as described with reference to FIG. 2. Construction in this manner creates a means 38 for opening or separating the second layer of film 32 which, when expanded, is bordered on both sides by elastic strip portions 24*a*, 24*b*. As described with reference to FIG. 2, one skilled in the art would understand numerous methods for attaching the elastic strip 24 to the second layer of film 32.

Also embodied by the present disclosure is a method of covering the container 12 using the above-described container cover 10, as illustrated in FIGS. 1–3. Container covers 10, constructed in accordance with the teachings of this disclosure, comprise the two layers of ovate-shaped film 22, 32, one of which is provided with the elastic strip 24, the layers being heat sealed at their perimeters 26 and scored such that the user can create a cover opening 38 bordered by elastic 24*a*, 24*b*. Specifically, the user operates the container cover 10 by pulling apart the two pieces of the second layer of film 32, as defined by the score line 42, expanding the opening 38 to a size appropriate for covering the given container 12, and placing the cover 10 atop the open container 12. As best depicted in FIG. 1, the construction of the container cover 10 is such that a dome is formed by the first layer 22 upon expansion of the opening 38 by the user. Stated differently, when the opening 38 is created in the container cover 10 and the two pieces of the second layer of film 32 are expanded to be substantially perpendicular to the first layer of film 22, the first layer of film 22 forms a dome, while the opening 38 of the cover 10 is secured around the walls 40 of the container 12 via the elastic edging 24*a*, 24*b* disposed on the second layers of film 32. In this manner, the second layer of film 32 forms first and second flaps 32*a*, 32*b* which are adjacent the outside walls 40 of the container 12, while the first layer 22 is positioned substantially over the opening of the container 12. As opposed to loose-fitting, shapeless conventional container covers, this method of construction takes better advantage of the surface area of the container cover 10 while providing a firm fit around the opening of the container 12. Moreover, the container cover 10 of the present disclosure further provides a method for covering containers 12 wherein the container cover 10 will not come in contact with the contents of the container 12. Whereas conventional container covers are loose-fitting and shapeless, the container covers of the present disclosure, when constructed using a more rigid material than thermoplastic film 22 (as described with reference to FIG. 1), result in a container cover 10 capable of forming a relatively stiff dome over the container (not shown). This feature is especially advantageous where the user does not want the cover 10 to come into contact with the contents of the container 12, e.g., where the cover 10 is functioning as a cake frosting protector. Also in accordance with the teachings of this disclosure are container covers 10 wherein the first layer of film 22 is adapted with stiffening strips (not shown), also for the purpose of forming an inflexible dome over the container 12.

Figure 4:
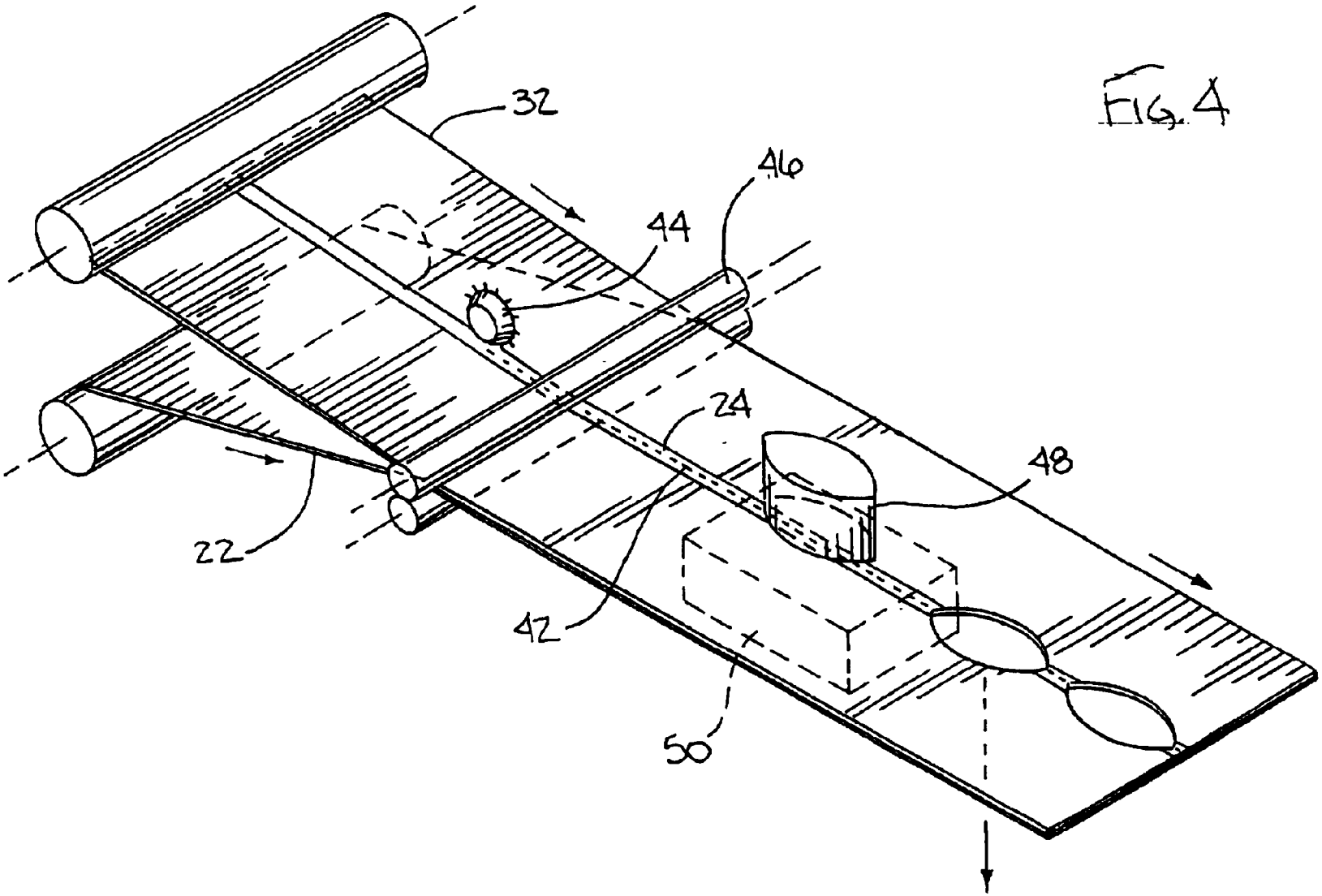
FIG. 4 illustrates a method of manufacturing container covers of the present disclosure.

Referring now to FIG. 4, provided in accordance with the teachings of the present disclosure is a method of manufacturing the container covers 10 depicted above in FIGS. 1–3. As depicted in FIG. 4, two webs or layers of film 22, 32 are provided and positioned parallel to each other, the first layer 22 illustrated below the second layer 32. While the method described herein uses two separate webs, those of ordinary skill in the art will appreciate that a single web, or more than two webs, may be used without departing from the teachings of the disclosure. As depicted, the first layer of film 22 is solid, non-perforated film. However, as described with reference to FIG. 1, numerous variations of this layer 22 will be understood by one with skill in the art. This automated method of manufacturing requires that the second web or layer of film 32 be associated with an elastic strip 24 running continuously down the length of the film 32. This may be accomplished by a co-extrusion process, adhesive, spot welding, or the like. As described above, with reference to FIG. 3, the elastic strip 24 and the second layer of film 32 are scored along the same line 42, thereby allowing the user to separate the film 32 and create an opening 38. The perforation/score line 42 may be accomplished using a toothed wheel 44, as depicted in FIG. 4. This rotating, toothed wheel 44 operates by puncturing both the elastic strip 24 and the second layer of film 32 in a straight line down the center of the elastic strip 24. At this stage in manufacturing, the two layers of film 22, 32 are still separated, thus only the elastic 24 and the second layer of film 32 are punctured by the perforator wheel 44. As best shown in FIG. 4, the two layers of film 22, 32, where the first layer 22 is unaltered and the second layer 32 has a score line 42 aligned with an attached, scored 42 elastic strip 24, are forced together between rollers 46.

Thereafter, an ovate shape is cut through the two layers of film 22, 32 and the perimeters of the film are heat sealed together. Specifically, the film 22, 32 is cut using an ovate-shaped die 48 pressing against an anvil 50 such that the elastic strip 24 extends between the two points 28, 30 of the ovate shape. The die 48 is preferably heated so as to not only form a cut, but to create a seal as well. One skilled in the art may employ different methods of attaching the two layers of film 22, 32 to one another while still in accordance with the teachings of the disclosure.

Figure 5:
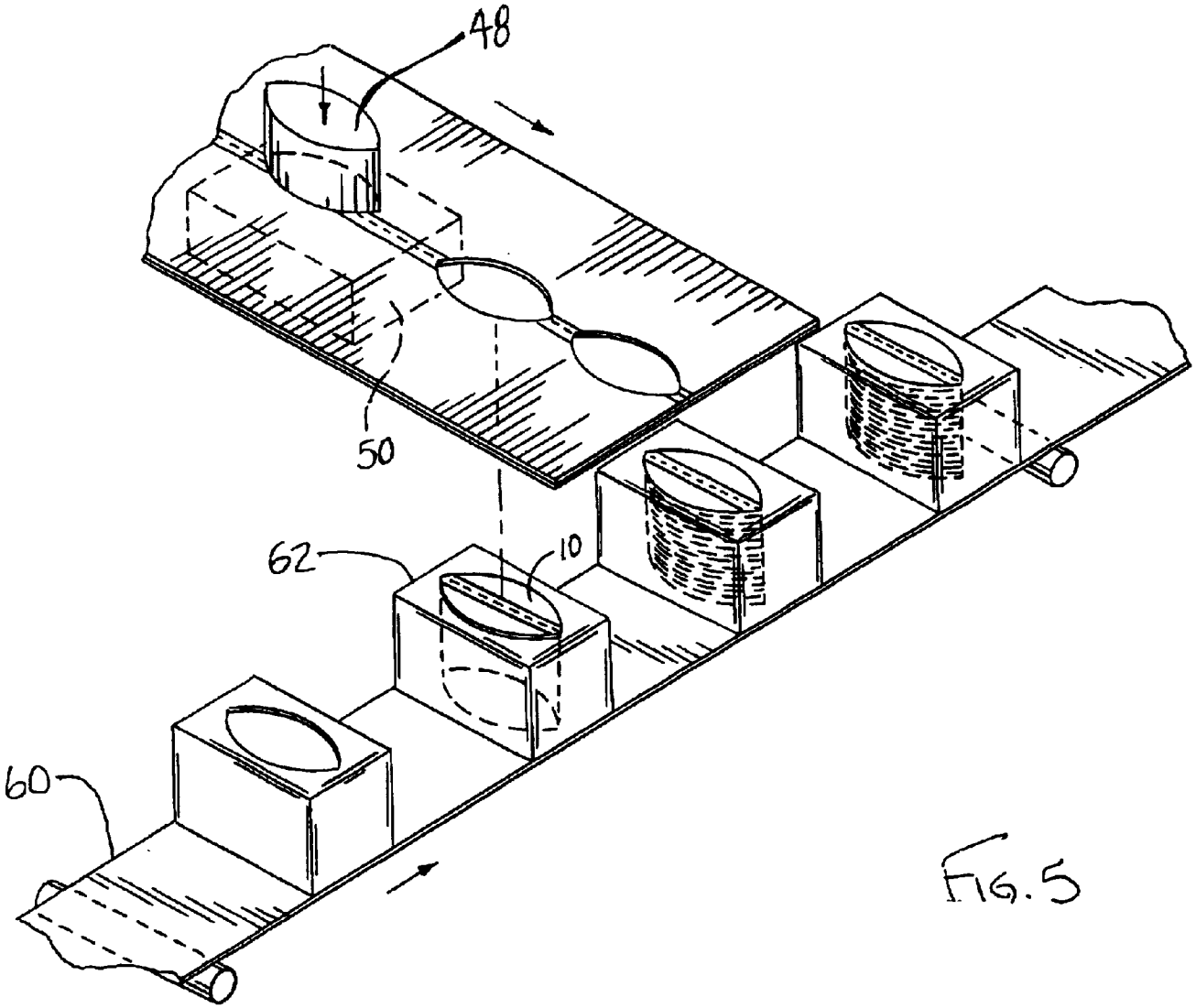
FIG. 5 illustrates a method of packaging container covers of the present disclosure.

The ovate-shaped container covers 10 may be quickly and easily packaged for delivery. As best shown in FIG. 5, a conveyor 60 carrying a plurality of receptacles, such as boxes 62, may be positioned below the two layers of film 22, 32 downstream of the die 48 and anvil 50. As a newly formed container cover 10 is advanced past the anvil 50, it may drop or otherwise be forced downwardly so that the cover drops into a box 62 on the conveyor 60. The conveyor 60 may be operated so that several covers 10 are deposited into a single box 62 before advancing.

While certain representative embodiments and details have been shown for purposes of illustrating the disclosure, it will be apparent to those skilled in the art that various changes in the methods and apparatus disclosed herein may be made without departing from the scope of the disclosure, which is defined in the appended claims.

What is claimed is:

1. A container cover, comprising:

first and second layers of film situated planar to each other, the first and second layers having an ovate shape and being joined at respective perimeters;

the second layer of film being scored along a line running between first and second points on the perimeter; and an elastic strip attached to the second layer of film, proximate the scored line.

2. The container cover of claim 1, wherein the film is a plastic material.

3. The container cover of claim 1, wherein the film is perforated.

4. The container cover of claim 1, wherein the elastic strip is an elastic material sewn directly to the film.

5. The container cover of claim 1, wherein the elastic strip is an elastic material glued directly to the film.

6. The container cover of claim 1, wherein the elastic strip is an elastic material heat sealed directly to the film.

7. The container cover of claim 1, wherein the elastic strip is scored.

8. The container cover of claim 1, wherein the first layer of film is more rigid than the second.

9. The container cover of claim 1, further including at least one rigid strip operatively associated with the first layer.

10. The container cover of claim 1, wherein the first and second layers include opposed pointed ends, the score line extending between the opposed pointed ends.

11. The container cover of claim 1, wherein the perimeters of the first and second layers of film are heat sealed together.

12. A method of manufacturing a container cover, comprising the steps of:

providing a first web portion of film;

positioning a second web portion of film atop the first web portion of film;

securing a strip of elastic to the second web portion of film;

perforating the elastic strip and second web portion of film;

cutting a shape through the first web portion, second web portion, and elastic strip; and sealing the first web portion to the second web portion around a perimeter defined there between.

13. The method of claim 12, wherein the shape is ovate.

14. The method of claim 12, further including the step of securing the elastic strip to the second web portion of film.

15. The method of claim 12, further including the steps of simultaneously advancing the first web portion, second web portion, and elastic strip.

16. The method of claim 12, wherein the elastic strip is perforated prior to securing the elastic strip to the second web portion of the film.

17. The method of claim 12, wherein the cutting and sealing steps are performed by a heated knife formed in an ovate shape.

18. The method of claim 12, wherein the perforating step is performed by a rotating, toothed wheel.

19. The method of claim 12, wherein the first and second web portions are provided by separate first and second webs of film, respectively.

20. A method of covering a container, comprising the steps of:

providing an ovate-shaped container cover having first and second layers of film, an elastic strip being attached to the second layer of film, wherein the second layer of film and elastic strip are scored;

pulling apart the second layer of film and elastic strip adjacent the score line; and placing the film over a container, the second layer being adjacent outside walls of the container, the elastic strip gripping the container.

21. The method of claim 20, wherein the container cover is situated such that the first layer of film forms a dome over the container.

22. The method of claim 20, wherein the container cover is situated to fit closely atop the container.

23. A container cover adapted to be expanded between first and second positions, the cover comprising:

a planar top wall having an ovate perimeter;

a planar side wall connected to the ovate perimeter at a first edge; and an elastic strip operatively associated with the side wall at a second edge thereof, the side wall being parallel to the top wall when in the first position, the side wall being transverse to the top wall when in the second position.

24. The container cover of claim 23, wherein the elastic strip extends between pointed ends of the ovate shape.

25. The container cover of claim 23, wherein the top wall forms a dome when situated atop the container.

26. The container cover of claim 23, wherein the container cover is situated to fit closely atop the container.

* * * * *